US006026899A

United States Patent [19]

Arizmendi et al.

[11] Patent Number: 6,026,899

[45] Date of Patent: Feb. 22, 2000

[54] HIGH EXPANSION SLIP SYSTEM

[75] Inventors: Napoleon Arizmendi, Magnolia; Brett Bouldin, Spring, both of Tex.

[73] Assignee: PES, Inc., The Woodlands, Tex.

[21] Appl. No.: 08/937,922

[22] Filed: Sep. 27, 1997

[51] Int. Cl.[7] ..... E21B 23/08

[52] U.S. Cl. ..... 166/216; 166/217

[58] Field of Search ..... 166/123, 138, 166/181, 216, 217

[56] References Cited

U.S. PATENT DOCUMENTS

| | | | |
|---|---|---|---|
| 4,437,517 | 3/1984 | Bianchi et al. | 166/217 |
| 5,348,090 | 9/1994 | Leismer | 166/217 |
| 5,487,427 | 1/1996 | Curington | 166/217 |

*Primary Examiner*—William Neuder
*Attorney, Agent, or Firm*—Alan J. Atkinson

[57] ABSTRACT

A high expansion slip system for anchoring a tool to a downhole wellbore surface. A slip is initially retained within the interior volume of a tool body for installation downhole in the wellbore. The slip has an inclined surface which moves the slip radially outwardly when the slip is move axially along a longitudinal axis through the tool body. Two opposing slips can be operated to center the tool body within the wellbore, and the setting of the two slips can be synchronized to control the tool body position and setting force on each slip. After the slips have been moved from the interior space to engage the wellbore surface, the hollow interior space within the tool body is unobstructed to open an unobstructed flow path for passage of fluids or well tools.

16 Claims, 2 Drawing Sheets

Section A–A

Section B–B

Section D–D

Section E–E

HIGH EXPANSION SLIP SYSTEM

BACKGROUND OF THE INVENTION

The present invention relates to slip systems useful for anchoring devices to downhole surfaces found in open wellbores or casing pipe. More particularly, the invention relates to a high expansion slip system which is expandable from a narrow profile to engage a downhole surface.

Compression slip devices anchor wellbore tools to open wellbores and to the interior wall of casing set within a wellbore. Conventional wellbore tools using slip devices include packers, plugs and straddles. Slip devices are constructed in many different configurations, including cone types, dovetails, collets, wedges, C-rings, and other known devices. These conventional slip devices may also use a retainer device such as a cage, slip ring, pocket, fracturable ring, collet or other device.

Slip design is typically integrated into the wellbore tool cooperating with the slips system. For a packer, a cylindrical packer body typically provides a chassis for containing the packer element, a slip system, and for containing the interior pressure within the packer body interior. The packer element has an outside diameter greater than the outside diameter of the packer body as the packer is lowered into a wellbore, and the radial difference between these two diameters is defined as "annular thickness". Conventional slip systems fit within this annular thickness so that the exterior dimension is insertable into the wellbore, and so that the interior dimension does not interfere with fluid flow and tool movement through the system. Multiple stair-stepped cones have been proposed to expand the effective radial reach of a backup ring system, however such systems are complex and do not have a high degree of reliability.

One form of high expansion, through-tubing slip system was disclosed in U.S. Pat. No. 3,706,342 to Woolley (1972). Woolley disclosed a seal element positioned about a cylinder which was expanded by an overlapping system of mechanical fingers. After the apparatus was lowered through a well tubing, two opposing sets of fingers were drawn together to compress and radially expand a packing element. As in other conventional slip systems, the interior dimension available for fluid flow and tool movement was limited to the interior body dimension of the tool mandrel.

SUMMARY OF THE INVENTION

The present invention provides an apparatus insertable into a wellbore for engaging a tool body with a downhole wellbore surface. The apparatus comprises a slip engaged with the body and intersected by a longitudinal axis through the tool body, wherein the slip is axially and radially moveable relative to the longitudinal axis. A slip gripping surface prevents relative movement between the slip and the wellbore surface, and the slip has an interior surface for defining a hollow space about the longitudinal axis when the slip engages the wellbore surface.

In other embodiments of the invention, a body has a longitudinal axis through a hollow interior, and first and second slips are axially and radially moveable relative to the longitudinal axis to engage the wellbore surface and to open the hollow interior of the body. In another embodiment of the invention, a guide has first and second sliding surfaces inclined from the longitudinal axis, and a first slip is in contact with the first sliding surface so that axial movement of the first slip toward the first sliding surface moves the first slip radially outwardly from the longitudinal axis. A second slip in contact with the second sliding surface is moveable anally toward said second inclined surface so that said second slip moves radially outwardly from the longitudinal axis to engage the wellbore surface.

DESCRIPTION OF THE PREFERRED EMBODIMENTS

Figure 1:
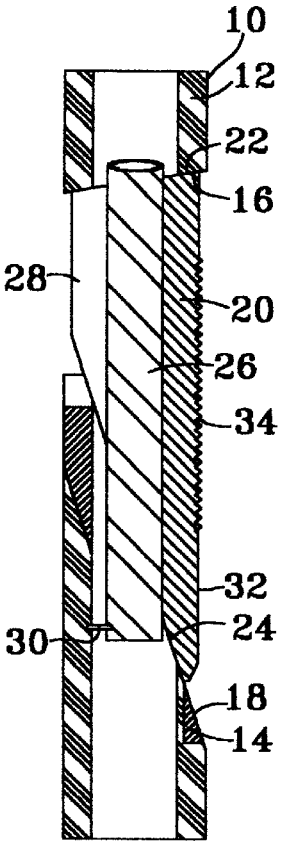
FIG. 1 illustrates a single slip which is axially and radially moveable to engage the wellbore surface and to open a flow path through the tool body.

The invention provides a high expansion slip system capable of engaging an open borehole or casing pipe interior or other downhole wellbore surface. FIG. 1 illustrates an embodiment of the invention, wherein tool body 10 is lowered downhole into a wellbore. Body 10 has upper end 12 and lower end 14 which is axially moveable toward upper end 12 along a longitudinal axis through body 10. Upper end 12 includes upper bevel 16, and lower end 14 includes lower bevel 18 in contact with slip 20. Slip 20 has inclined surfaces 22 and 24 in corresponding contact with upper bevel 16 and lower bevel 18. Setting tool 26 is positioned within a hollow interior 28 within body 10, and is initially retained to lower end 14 with shear pin 30.

Figure 2:
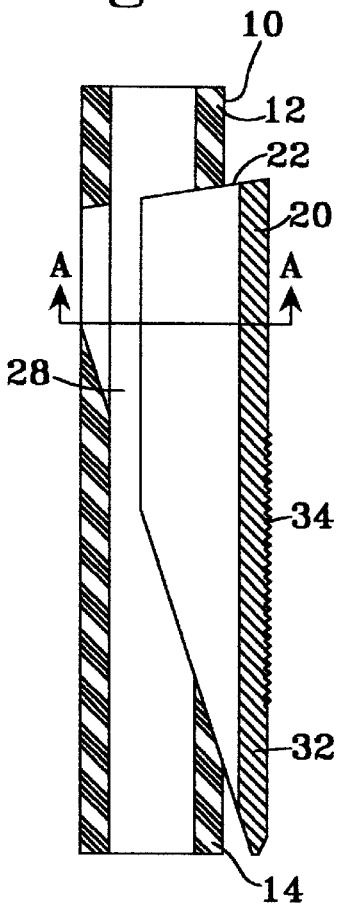
FIG. 2 illustrates the single slip in an extended position.

Upward movement of setting tool 26 draws lower end 14 toward upper end 12, and upper bevel 16 acts against slip inclined surface 22 and lower bevel 18 acts against slip inclined surface 24 to move slip 20 radially outwardly from the longitudinal axis through body 10. Slip 20 has an exterior surface 32 having gripping teeth 34 for engaging the wellbore surface as shown in FIG. 2, and has arcuate interior surfaces 36 and 38. Interior surface 36 provides a space for the initial position of setting tool 26 as shown in FIG. 1, and is also shown in FIG. 3 in the extended position of slip 20.

Body hollow interior 28 extends through upper end 12 and lower end 14 and provides a flow path for fluid transmission and for tool movement. For example, unobstructed hollow interior 28 permits the passage of well fluids produced from the wellbore, permits the entry of chemicals and other fluids from the wellbore surface downwardly into the wellbore, and permits passage of surface deployed tools such as logging and intervention tools. As illustrated, hollow interior 28 has an arcuate planar surface generally shaped as a cylinder. In the initial position of the invention, slip 20 at least partially obstructs body hollow interior 28.

Figure 3:
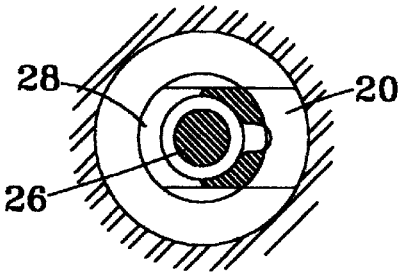
FIG. 3 illustrates a plan view of the single slip in an extended position.

When slip 20 is moved radially outwardly from the body 10 longitudinal axis, arcuate interior surface 38 generally aligns with the cylindrical surface of hollow interior 28 as shown in FIG. 3. Setting tool 26 is operated with sufficient force to break shear pin 30 and to remove setting tool 26 from hollow interior 28. Slip 20 can be locked relative to body 10 through conventional locking mechanisms or through techniques described more fully below. In this manner, the fully engaged orientation of slip 20 operates to engage the wellbore surface and to clear hollow interior 28 to create an unobstructed flow path through body 10.

Figure 4:
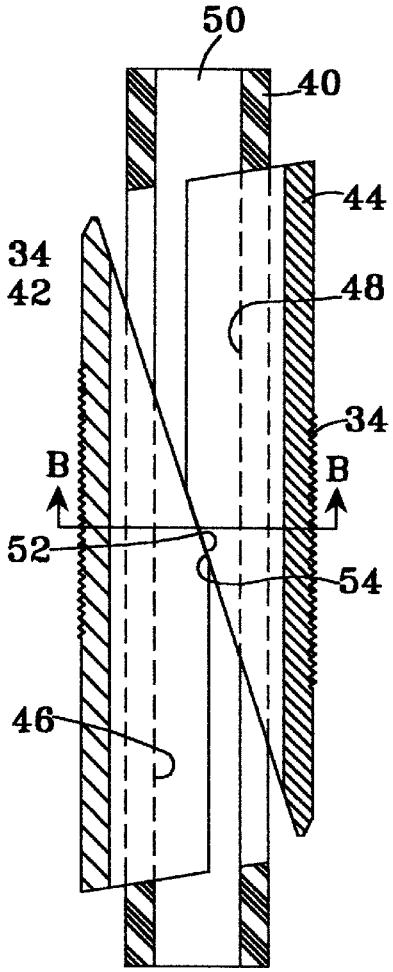
FIG. 4 illustrates first and second slips after the slips have been moved axially and radially to engage the wellbore surface and to open a flow path through the tool body.
Figure 5:
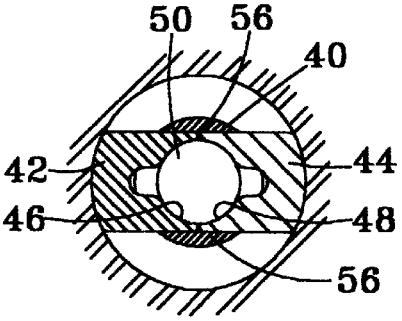
FIG. 5 illustrates a plan view of the two extended slips.

Multiple slips can be positioned within a downhole tool body to accomplish different gripping functions within the wellbore. FIGS. 4 and 5 illustrate another embodiment of the invention wherein body 40 is engaged with first slip 42 and second slip 44. As illustrated, first slip 42 and second slip 44 are extended radially outwardly from a longitudinal axis through body 40 until slips 42 and 44 engage the wellbore surface, and interior arcuate surfaces 46 and 48 are aligned with hollow interior 50 of body 40. Such alignment does not have to be absolute, and arcuate surfaces 46 and 48 can partially interfere with the flow path through hollow interior 50, or can be moved radially outwardly beyond the wall surface defined by hollow interior 50. As shown in FIG. 4, slips 42 and 44 have inclined surfaces 52 and 54 in contact with the other for urging slips 42 and 44 outwardly as slips 42 and 44 are moved axially toward the other along the longitudinal axis.

As illustrated in FIG. 4, inclined surfaces 52 and 54 form a plane approximately twenty degrees from the longitudinal axis. It will be appreciated by one skilled in the art that this angle can be varied to accomplish different responses between body 40, first slip 42 and second slip 44. As illustrated in FIG. 5, body 40 includes cage members 56 which constrain rotational and transverse movement of slips 42 and 44, and which provide structural integrity between upper and lower ends of body 40. This structural connection permits the setting force acting on slips 42 and 44 to be applied from either the top or the bottom of body 40.

The setting force acting on the slips is described as an axial force acting in a direction parallel to a longitudinal axis through the body of the apparatus. It will be appreciated by one skilled in the art that many different setting forces can be provided to accomplish the functional performance of the invention. In various embodiments of the invention, the setting force can be provided with a setting tool internal to the tool body, an external setting tool, with mechanical or hydraulic or electrical mechanisms, or with axial or rotational operation of well tubing or tool body components. In all of these embodiments, a slip is initially stored within the tool body to at least partially obstruct a flow path through the tool body, and such obstruction is removed when the slip is set against the downhole surface.

Figure 6:
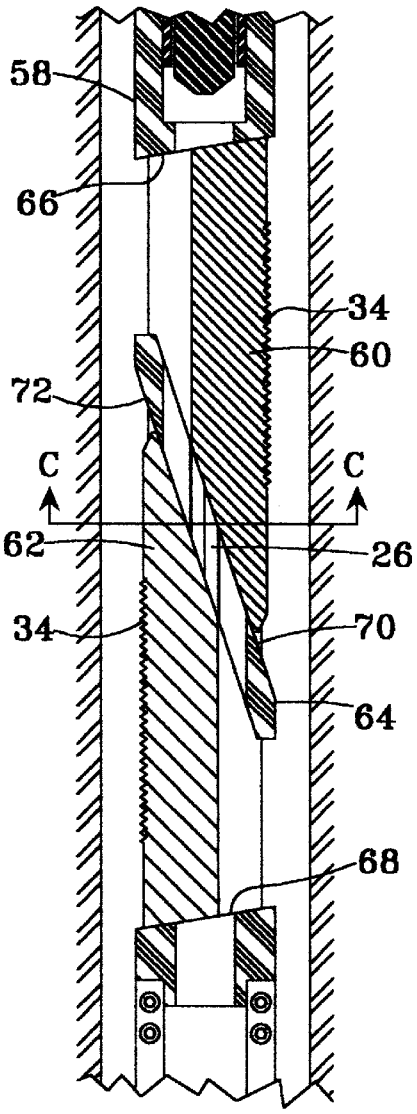
FIG. 6 illustrates another embodiment of the invention having a guide between first and second slips.

Referring to FIG. 6, an alternative embodiment of the invention is illustrated wherein body 58 constrains first slip 60, second slip 62, and guide 64. Setting tool 26 retains such components in an initial deployment position as body 58 is moved within the wellbore, and the removal of setting tool 26 provides for the movement of slips 60 and 62 into a set position illustrated in FIG. 7. Body 58 includes upper bevel 66 in contact with first slip 60, and lower bevel 68 in contact with second slip 62. Guide 64 is illustrated as a tubular member sectioned along a twenty degree angle from a longitudinal axis through body 58. Guide 64 has a first sliding surface 70 in contact with first slip 60, and a second sliding surface 72 in contact with second slip 62.

In a preferred embodiment of the invention, first slip 60 and second slip 62 contact the wellbore surface in an opposing fashion to provide the setting force across body 58 in a direction substantially perpendicular to the longitudinal axis through body 58. Additionally, first slip 60 and second slip 62 preferably contact the wellbore surface at substantially the same time with substantially the same setting force so that each slip 60 and 62 is fully and equally extended radially outwardly from body 58, and so that body 58 is centered within the wellbore. In other embodiments of the invention, either slip could be set in a different sequence to accomplish different objections. For example, in low side perforating or in chemical injection operations for horizontal wells, it may be desirable to have body 58 retained against the lower or upper portion of the wellbore. Selective engagement of one slip before the other would permit the desired result while accomplishing the function objectives of the invention.

Figure 8:
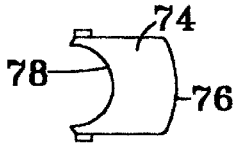
FIG. 8 illustrates one embodiment in plan view of a single slip.
Figure 9:
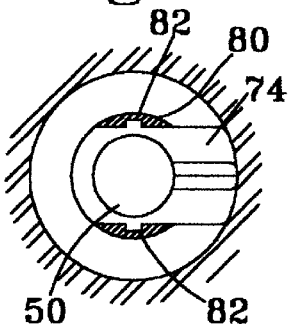
FIG. 9 illustrates the positioning of a slip within a body cage having retainer keyways.

FIG. 8 illustrates a plan view for one embodiment of slip 74 having outer gripping surface 76 and interior surface 78 for alignment with a cylindrical hollow interior through a tool body. FIG. 9 illustrates the combination of slip 74 with body 80, wherein dovetail channels 82 extend along the hollow interior of body 80. Such channels 82, in combination with an appropriately configured slip 74, can prevent slip 74 from prematurely moving radially from the longitudinal axis, and can limit the overall radial movement of slip 74 from the longitudinal axis. Although the longitudinal axis through body 74 and other embodiments shown herein is shown through the center of the hollow interior through body 74, all references herein to a longitudinal axis are made relative to the direction of movement and not to the absolute position or angular orientation of a longitudinal axis.

Figure 7:
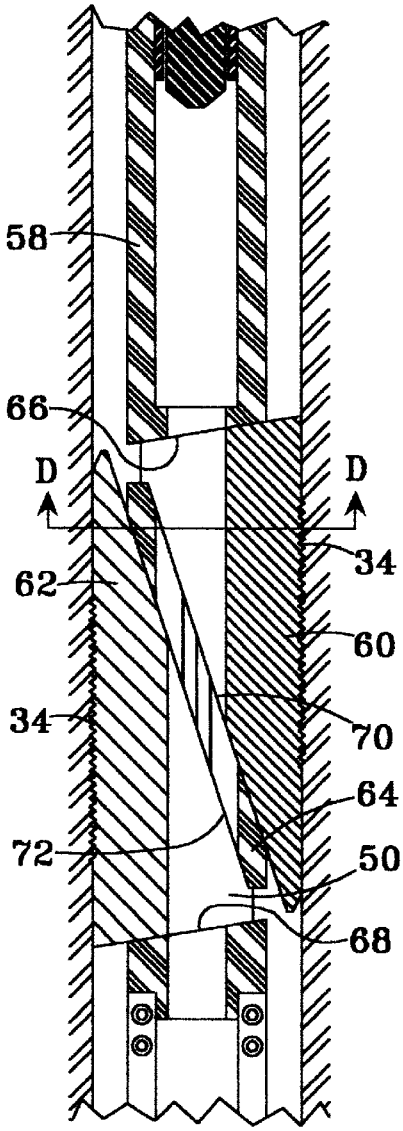
FIG. 7 illustrates the operability of the guide when the slips are extended to contact the wellbore surface.
Figure 11:
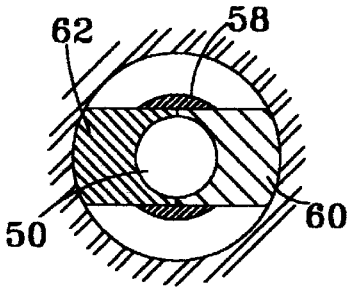
FIG. 11 illustrates the set orientation of two slips relative to the tool body.
Figure 10:
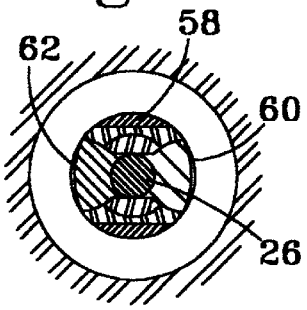
FIG. 10 illustrates the initial orientation of two slips as the tool body is run into a wellbore.

FIG. 10 illustrates a sectional view of the configuration shown in FIG. 6 wherein the tool body 58 can be run into the wellbore in a contained orientation. This configuration of the invention permits body 58 and slips 60 and 62 to be run through relatively narrow tubing within the wellbore, or to be run through a device such as a through tubing packer or a straddle. After body 58 has exited the confined space and reenters the open wellbore or full casing interior space, slips 60 and 62 can be set to engage the downhole surface as shown in FIGS. 7 and 11.

For an embodiment of the invention having more than one slip, the discontinuous nature of the slip elements uniquely permits the components to be installed on a slimhole basis, and permits maximum expansion of the slip elements into the open wellbore. Accordingly, the installation orientation of the slip elements provides an extremely compact package which resists component damage as the tool is lowered into the wellbore, and which provides a reliable setting apparatus. The setting force can be carried across the tool body which is also suitable for carrying the setting force, all axial loads, and any tail pipe weight in the downhole well installation. For a system requiring a production packer with a sealing tailpipe, the invention can be run between two packing elements to provide the desired sealing capabilities.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

We claim:

1. An apparatus insertable into a wellbore for engaging a hollow tool body with a downhole wellbore surface, comprising:

a slip engaged with the body and intersected by a longitudinal axis through the tool body, wherein said slip is axially and radially moveable relative to said longitudinal axis;

a gripping surface on said slip for engaging the wellbore surface to prevent relative movement therebetween after said slip is moved radially from the longitudinal axis;

an interior surface on said slip for defining a hollow space about the longitudinal axis when said gripping surface engages the wellbore surface; and means for moving said slip from said position proximate to said longitudinal axis until said gripping surface engages the wellbore surface, wherein said hollow space defined by said slip interior surface provides an unobstructed path through the tool body when said slip gripping surface engages the wellbore surface.

2. An apparatus as recited in claim 1, wherein said downhole wellbore surface comprises the interior wall surface of a casing pipe.

3. An apparatus as recited in claim 1, wherein said slip comprises a first slip having a first sliding surface inclined from the longitudinal axis, and further comprising a second slip having a second sliding surface inclined from the longitudinal axis and in contact with said first sliding surface.

4. An apparatus for engaging a downhole wellbore surface, comprisng:

a body having a longitudinal axis through a hollow interior;

a first slip axially and radially moveable relative to said longitudinal axis, wherein said first slip is positioned within said hollow interior and is radially moveable outwardly from said longitudinal axis to engage the wellbore surface and to open said body hollow interior to form an unobstructed path through said body hollow interior; and a second slip axially and radially moveable relative to said longitudinal axis, wherein said second slip is positioned within said hollow interior and is radially moveable outwardly from said longitudinal axis to engage the wellbore surface and to open said body hollow interior to form an unobstructed path through said body hollow interior.

5. An apparatus as recited in claim 4, wherein said first slip has a first surface inclined relative to the longitudinal axis, and wherein said second slip has an inclined second surface in sliding contact with said the first surface of said first slip.

6. An apparatus as recited in claim 4, wherein said radial movement of said second slip is in a direction opposite to said radial movement of said first slip.

7. An apparatus as recited in claim 4, further comprising a stop for limiting radial movement of said first and second slips from said longitudinal axis.

8. An apparatus as recited in claim 4, further comprising a means for synchronizing the outward radial movement of said first and second slips.

9. An apparatus as recited in claim 4, further comprising a lock for retaining said first and second slips in engagement with the wellbore surface.

10. An apparatus operable by a tool to engage a downhole wellbore surface, comprising:

a body having a longitudinal axis through a hollow interior;

a guide having first and second sliding surfaces inclined from said longitudinal axis;

a first slip proximate to said longitudinal axis and in contact with said first sliding surface, wherein axial movement of said first slip toward said first sliding surface moves said first slip radially outwardly from said longitudinal axis to engage the wellbore surface; and a second slip proximate to said longitudinal axis and in contact with said second sliding surface, wherein axial movement of said second slip toward said second sliding surface moves said second slip radially outwardly from said longitudinal axis to engage the wellbore surface.

11. An apparatus as recited in claim 10, wherein said first slip and said second slip are configured to be retained by the tool in a position proximate to said longitudinal axis until the tool is operated to permit movement of said first slip and said second slip relative to said longitudinal axis.

12. An apparatus as recited in claim 11, wherein the tool can be positioned coincident with said longitudinal axis to retain said first slip and said second slip in positions to prevent axial and radial movement relative to said first sliding surface and said second sliding surface, and wherein the tool is operable to permit movement of said first slip and said second slip relative to said guide.

13. An apparatus as recited in claim 11, wherein the hollow interior through said body has an angular profile, and said first slip has an angular inner surface alignable with the angular profile of said body hollow interior when said first slip engages the wellbore surface, and wherein said second slip has an angular inner surface alignable with the angular profile of said body hollow interior when said second slip engages the wellbore surface.

14. An apparatus as recited in claim 10, wherein said second slip is configured to move radially outwardly in a direction opposing the radial movement of said first slip.

15. An apparatus as recited in claim 10, wherein said first slip is moveable in an axial direction opposite the axial movement of said second slip as said first and second slips move radially outwardly from said longitudinal axis to engage the wellbore surface.

16. An apparatus as recited in claim 15, wherein said first and second slips engage the wellbore surface at substantially opposite positions relative to said longitudinal axis.

* * * * *